US008298471B2

(12) United States Patent
Venkatesh et al.

(10) Patent No.: US 8,298,471 B2
(45) Date of Patent: Oct. 30, 2012

(54) PROCESS FOR PRODUCING NANO- AND MESOFIBERS BY ELECTROSPINNING COLLOIDAL DISPERSIONS COMPRISING AT LEAST ONE ESSENTIALLY WATER-INSOLUBLE POLYMER

(75) Inventors: Rajan Venkatesh, Mannheim Neckarstadt-Ost (DE); Evgueni Klimov, Ludwigshafen (DE)

(73) Assignee: BASF SE (DE)

( * ) Notice: Subject to any disclaimer, the term of this patent is extended or adjusted under 35 U.S.C. 154(b) by 123 days.

(21) Appl. No.: 12/747,842

(22) PCT Filed: Dec. 11, 2008

(86) PCT No.: PCT/EP2008/067281

§ 371 (c)(1),
(2), (4) Date: Jun. 11, 2010

(87) PCT Pub. No.: WO2009/074630

PCT Pub. Date: Jun. 18, 2009

(65) Prior Publication Data

US 2011/0148004 A1 Jun. 23, 2011

(30) Foreign Application Priority Data

Dec. 11, 2007 (EP) ..... 07122897

(51) Int. Cl.
*B29C 35/02* (2006.01)
*D06M 10/00* (2006.01)
*H05B 7/00* (2006.01)

(52) U.S. Cl. ..... 264/465; 264/236

(58) Field of Classification Search ..... 264/236, 264/465

See application file for complete search history.

(56) References Cited

U.S. PATENT DOCUMENTS

| | | | | |
|---|---|---|---|---|
| 3,923,714 | A * | 12/1975 | Barabas et al. | 524/531 |
| 5,869,180 | A | 2/1999 | Budenbender et al. | |
| 6,332,291 | B1 | 12/2001 | Flosbach et al. | |
| 6,583,214 | B1 | 6/2003 | Haeberle et al. | |
| 6,667,099 | B1 | 12/2003 | Greiner et al. | |
| 6,677,045 | B1 | 1/2004 | Schwaim et al. | |
| 6,720,384 | B1 | 4/2004 | Mayer et al. | |
| 6,727,316 | B1 | 4/2004 | Bremser | |
| 7,255,820 | B2 | 8/2007 | Lee et al. | |
| 2003/0026985 | A1 | 2/2003 | Greiner et al. | |
| 2004/0106733 | A1 | 6/2004 | Lee et al. | |

(Continued)

FOREIGN PATENT DOCUMENTS

CA 2055419 6/1992

(Continued)

OTHER PUBLICATIONS

Reneker et al., "Nanometre diameter fibres of polymer, produced by electrospinning." *Nanotechnology* (1996). vol. 7, pp. 216-223.

(Continued)

*Primary Examiner* — Leo B Tentoni

(74) *Attorney, Agent, or Firm* — Connolly Bove Lodge & Hutz LLP

(57) ABSTRACT

The present invention relates to a process for producing polymer fibers, especially nano- and mesofibers, by electrospinning a colloidal dispersion of at least one essentially water-insoluble polymer in an aqueous medium, and to fibers obtainable by this process, to textile fabrics comprising the inventive fibers, and to the use of the inventive fibers and of the inventive textile fabrics.

10 Claims, 3 Drawing Sheets

U.S. PATENT DOCUMENTS

Figure 1:
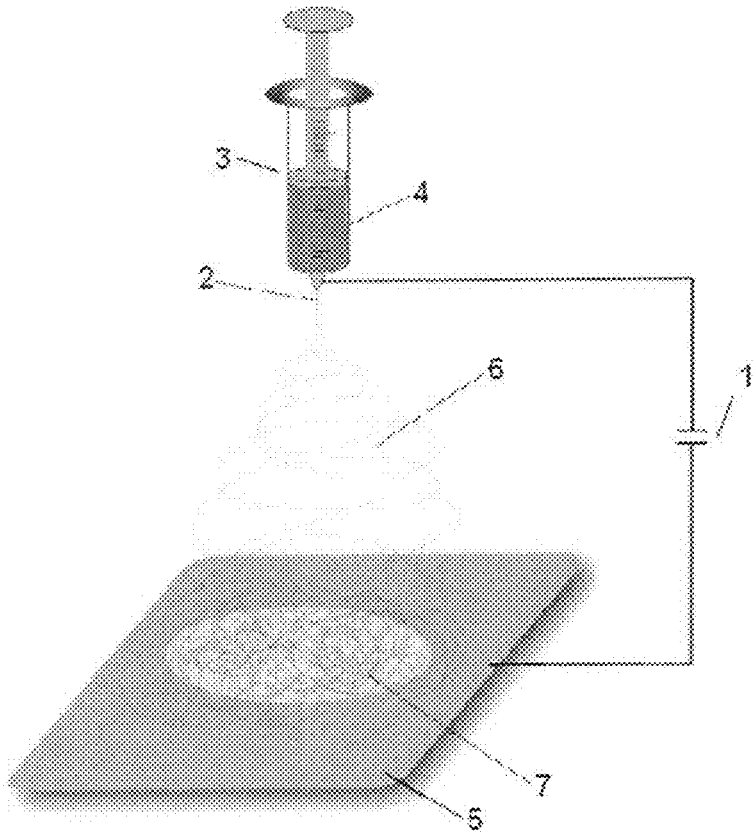

| | | | | |
|---|---|---|---|---|
| 2004/0241436 | A1* | 12/2004 | Hsieh et al. | 428/361 |
| 2007/0018361 | A1* | 1/2007 | Xu | 264/465 |
| 2008/0261043 | A1* | 10/2008 | Greiner et al. | 264/465 X |
| 2009/0087469 | A1* | 4/2009 | Zhang et al. | 264/484 X |
| 2010/0120315 | A1* | 5/2010 | Imashiro et al. | 264/484 X |

FOREIGN PATENT DOCUMENTS

| | | |
|---|---|---|
| DE | 19600162 | 7/1997 |
| DE | 19736083 | 2/1999 |
| DE | 19818735 | 10/1999 |
| DE | 19904317 | 8/2000 |
| DE | 19914896 | 10/2000 |
| DE | 19930067 | 1/2001 |
| DE | 10133393 | 1/2003 |
| DE | 10355565 | 6/2004 |
| DE | 102004009887 | 7/2005 |
| DE | 102006049666 | 4/2006 |
| EP | 0486881 | 5/1992 |
| JP | 10-018125 | 1/1998 |
| WO | WO-93/24684 | 12/1993 |
| WO | WO-01/09414 | 2/2001 |
| WO | WO-2004/048644 | 6/2004 |
| WO | WO-2004080681 | 9/2004 |
| WO | WO-2005/026398 | 3/2005 |
| WO | WO-2006/089522 | 8/2006 |
| WO | WO-2008/010199 | 1/2008 |
| WO | WO-2008123345 A1 * | 10/2008 |

OTHER PUBLICATIONS

Jin et al., "Electrospinning *Bombyx mon* Silk with Poly(ethylene oxide)." *Biomacromolecuites* (2002). vol. 3, pp. 1233-1239.

Nagapudi et al., "Photomediated Solid-State Cross-Linking of an Elastin-Mimetic Recombinant Protein Polymer," *Macromolecules* (2002). vol. 35. pp. 1730-1737.

Kim et al., "Reactive Electrospinning of Cross-Linked Poly(2-hydroxyethyl methacrylate) Nanofibers and Elastic Properties of Individual Hydrogel Nanofibers in Aqueous Solutions." *Macromolecules* (2005), vol. 38, pp. 3719-3728.

Choi et al., "Fabrication and Characterization of Electrospan Polybutadiene Fibers Crosslinked by UV irradiation," *Journal of Applied Polymer Science* (2006), vol. 101, pp. 2333-2337.

Stoiljkovic et al., "Preparation of water-stable submicron fibers from aqueous latex dispersion of water-insoluble polymers by electrospinning." *Polymer* (2007), vol. 46, pp. 3974-3981.

English-language of International Preliminary Report on Patentability of international application PCT/EP2008/067281, Sep. 28, 2010.

* cited by examiner

PROCESS FOR PRODUCING NANO- AND MESOFIBERS BY ELECTROSPINNING COLLOIDAL DISPERSIONS COMPRISING AT LEAST ONE ESSENTIALLY WATER-INSOLUBLE POLYMER

CROSS REFERENCE TO RELATED APPLICATIONS

This application is a national stage application under 35 U.S.C. §371 of PCT/EP2008/067281, filed Dec. 11, 2008, which claims benefit to European application 07122897.7, filed Dec. 11, 2007, the entire disclosures of which are hereby incorporated by reference.

The present invention relates to a process for producing polymer fibers, especially nano- and mesofibers, by electrospinning a colloidal dispersion of at least one essentially water-insoluble polymer in an aqueous medium, and to fibers obtainable by this process, to textile fabrics comprising the inventive fibers, and to the use of the inventive fibers and of the inventive textile fabrics.

For the production of nano- and mesofibers, a multitude of processes are known to those skilled in the art, among which electrospinning is currently of the greatest significance. In this process, which is described, for example, by D. H. Reneker, H. D. Chun in Nanotechn. 7 (1996), page 216 ff., a polymer melt or a polymer solution is typically exposed to a high electrical field at an edge which serves as an electrode. This can be achieved, for example, by extrusion of the polymer melt or polymer solution in an electrical field under low pressure by a cannula connected to one pole of a voltage source. Owing to the resulting electrostatic charge of the polymer melt or polymer solution, there is a material flow directed toward the counterelectrode, which solidifies on the way to the counterelectrode. Depending on the electrode geometries, nonwovens or assemblies of ordered fibers are obtained by this process.

DE-A1-101 33 393 discloses a process for producing hollow fibers with an internal diameter of from 1 to 100 nm, in which a solution of a water-insoluble polymer—for example a poly-L-lactide solution in dichloromethane or a polyamide-46 solution in pyridine—is electrospun. A similar process is also known from WO-A1-01/09414 and DE-A1-103 55 665.

DE-A1-196 00 162 discloses a process for producing lawnmower wire or textile fabrics, in which polyamide, polyester or polypropylene as a thread-forming polymer, a maleic anhydride-modified polyethylene/polypropylene rubber and one or more aging stabilizers are combined, melted and mixed with one another, before this melt is melt-spun.

DE-A1-10 2004 009 887 relates to a process for producing fibers having a diameter of <50 μm by electrostatic spinning or spraying of a melt of at least one thermoplastic polymer.

The electrospinning of polymer melts allows only fibers of diameters greater than 1 μm to be produced. For a multitude of applications, for example filtration applications, however, nano- and/or mesofibers having a diameter of less than 1 μm are required, which can be produced with the known electrospinning processes only by use of polymer solutions.

However, these processes have the disadvantage that the polymers to be spun first have to be brought into solution. For water-insoluble polymers, such as polyamides, polyolefins, polyesters or polyurethanes, nonaqueous solvents—regularly organic solvents—therefore have to be used, which are generally toxic, combustible, irritant, explosive and/or corrosive.

In the case of water-soluble polymers, such as polyvinyl alcohol, polyethylene oxide, polyvinylpyrrolidone or hydroxypropylcellulose, it is possible to dispense with the use of nonaqueous solvents. However, the fibers obtained in this way are by their nature water-soluble, which is why their industrial use is very limited. For this reason, these fibers have to be stabilized toward water after the electrospinning by at least one further processing step, for example by chemical crosslinking, which constitutes considerable technical complexity and increases the production costs of the fibers.

WO 2004/080681 A1 relates to apparatus and processes for the electrostatic processing of polymer formulations. The polymer formulations may be solutions, dispersions, suspensions, emulsions, mixtures thereof or polymer melts. One process mentioned for electrostatic processing is electrospinning. However, WO 2004/080681 A1 does not mention any specific polymer formulations which are suitable for electrospinning.

WO 2004/048644 A2 discloses the electrosynthesis of nanofibers and nanocomposite films. For the electrospinning, solutions of suitable starting substances are used. According to the description, the term "solutions" also comprises heterogeneous mixtures such as suspensions or dispersions. According to WO 2004/048644 A2, fibers can be produced, inter alia, from electrically conductive polymers. According to WO 2004/048644 A2, these are obtained preferably from the solutions comprising the corresponding monomers.

WO 2006/089522A1 relates to a process for producing polymer fibers by electrospinning a colloidal dispersion of at least one essentially water-insoluble polymer in an aqueous medium. In this process, it was possible for the first time to spin aqueous polymer dispersions by means of an electrospinning process to obtain polymer fibers, especially nano- or mesofibers. According to WO2006/089522 A1, the essentially water-insoluble polymers can be used in uncrosslinked or crosslinked form. In addition, subsequent crosslinking of the resulting polymer fibers is possible. Crosslinking during the electrospinning process is not mentioned in WO2006/089522 A1.

With the aid of the process described in WO 2006/089522A1 it has been possible to avoid the aforementioned disadvantages of the prior art, and to provide a process for producing water-stable polymer fibers, especially nano- and mesofibers, by the electrospinning process, in which it is possible to dispense with the use of nonaqueous solvents to prepare a polymer solution and an aftertreatment of the electrospun fibers to stabilize them with respect to water.

It is an object of the present invention to provide a process for electrospinning aqueous polymer dispersions, with which polymer fibers can be obtained with thermal properties optimized as compared to the polymer fibers disclosed in WO 2006/089522A1, especially with a high elasticity at high temperatures.

The object is achieved by providing a process in which a colloidal dispersion of at least one essentially water-insoluble polymer is electrospun in an aqueous medium.

In the process according to the invention, the at least one essentially water-insoluble polymer is crosslinked by interparticulate crosslinking during the electrospinning.

The process according to the invention can provide fibers with a high water stability, which are notable for good thermal stability, especially a relatively high elasticity at high temperatures. It is possible, by the process according to the invention, to produce nano- and mesofibers having a diameter of less than 1 μm from aqueous dispersions, such that the use of non-aqueous toxic, combustible, irritant, explosive and/or corrosive solvents can be avoided. Since the fibers produced by the process according to the invention are formed from essentially water-insoluble polymers, a further process step for water stabilization of the fibers is not required. In addition, a crosslinking step which follows the production of the fibers is not required.

The process according to the invention has the advantage that, without additional further process steps, it is possible by means of the process according to the invention to obtain polymer fibers which are notable for a high thermal stability and a good elasticity at high temperatures.

In addition, it has been found that, surprisingly, interparticulate crosslinking by the process according to the invention provides polymer fibers which have a significantly higher elasticity at high temperatures and a better stability than polymer fibers which are formed from an essentially water-insoluble polymer which has been crosslinked intramolecularly before the start of the process according to the invention.

In the process according to the invention for producing the polymer fibers, a colloidal dispersion of at least one essentially water-insoluble polymer is electrospun in an aqueous medium. In the context of the present invention, essentially water-insoluble polymers are understood to mean especially polymers having a solubility in water of less than 0.1% by weight.

In accordance with textbook knowledge, a dispersion in the context of the present invention refers to a mixture of at least two mutually immiscible phases, wherein one of the at least two phases is liquid. Depending on the state of matter of the second or further phase, dispersions are subdivided into aerosols, emulsions and suspensions, the second or further phase being gaseous in the case of aerosols, liquid in the case of emulsions and solid in the case of suspensions. In the process according to the invention, preference is given to using suspensions. The colloidal polymer dispersions to be used with preference in accordance with the invention are also referred to as latex in technical terms.

According to the invention, the interparticulate crosslinking of the essentially water-insoluble polymer is effected after the preparation of the colloidal dispersion of the essentially water-insoluble polymer, used in the process according to the invention, during the process for producing polymer fibers, i.e. during the electrospinning. This means that the polymer is crosslinked on the way from the spinning source (needle (cannula), roller) to the counterelectrode in the electrospinning process according to the invention, generally during evaporation of liquid medium.

Preference is given to effecting the interparticulate crosslinking through formation of covalent bonds, the crosslinking generally being effected thermally and/or photochemically (by means of actinic radiation) and/or catalytically (by means of addition of, for example, $H^+$ or $OH^-$).

In the context of the present invention, thermal crosslinking is understood to mean that the crosslinking is effected without the action of actinic radiation or the use of catalytic materials. This is also understood to mean performance of the process at room temperature or lower temperatures, in which case the crosslinking is effected during the evaporation of the aqueous medium without additional action of temperatures above room temperature.

In the context of the present application the term "photochemical crosslinking" comprises crosslinking with all kinds of high-energy radiation, such as UV radiation, VIS radiation, NIR radiation or electron beams.

In general, the at least one essentially water-insoluble polymer has reactive groups which are suitable for crosslinking and enable interparticulate crosslinking.

It is possible that the reactive groups which are suitable for crosslinking and are present in the essentially water-insoluble polymer react directly with reactive groups suitable for crosslinking in a further essentially water-insoluble polymer (variant a), or that the essentially water-insoluble polymers are crosslinked with one another using crosslinkers (variant b).

In the case of the suitable reactive groups, which react with one another according to variant a or variant b, it is possible that they are reactive functional groups which can react with groups of their own kind ("with themselves"), or reactive functional groups, which can react with complementary reactive functional groups. In principle, all possible combinations known to those skilled in the art for crosslinking are conceivable.

Examples of complementary reactive functional groups suitable for crosslinking are compiled in the overview which follows. In the overview, the variable R represents an acyclic or cyclic aliphatic, an aromatic and/or an aromatic-aliphatic (araliphatic) radical; the variables R' and R" represent identical or different aliphatic radicals or are bonded to one another to form an aliphatic or heteroaliphatic ring, and Hal is halogen, preferably Cl or Br.

Overview

Examples of Complementary Functional Groups

| Functional group in the polymer or Crosslinker (or if appropriate further functional group in the polymer when no crosslinker is used) | Crosslinker (or if appropriate further functional group in the polymer when no crosslinker is used) or Functional group in the polymer |
|---|---|
| —SH | —C(O)—OH |
| —$NH_2$ | —C(O)—O—C—(O)— |
| —OH | —NCO |
| —O—(CO)—NH—(CO)—$NH_2$ | —NH—C(O)—OR |
| —O—(CO)—$NH_2$ | —$CH_2$—OH |
| >NH | —$CH_2$—O—R |
| >NH | —NH—$CH_2$—OH |
| >NH | —N(—$CH_2$—O—R)$_2$ |
| >NH | —NH—C(O)—CH(—C(O)OR)$_2$ |
| >NH | —NH—C(O)—CH(—C(O)OR)(—C(O)—R) |
| >NH | —NH—C(O)—NR'R" |
| >NH | >Si(OR)$_2$ |

-continued

| Functional group in the polymer or Crosslinker (or if appropriate further functional group in the polymer when no crosslinker is used) | Crosslinker (or if appropriate further functional group in the polymer when no crosslinker is used) or Functional group in the polymer |
|---|---|
| >NH | 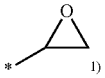 1) |
| >NH | 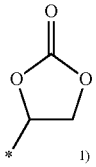 1) |
| —C(O)—OH | 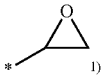 1) |
| —C(O)—OH | —$NH_2$ |
| —C(O)—OH | —NCO |
| —C(O)—OH | —Hal |
| —C(O)—OH | —C(O)—N($CH_2$—$CH_2$—OH)$_2$ |
| —O—C(O)—$CR^5$═$CH_2$ | —OH |
| —O—CR═$CH_2$ | —$NH_2$ |
| —O—CR═$CH_2$ | —C(O)—$CH_2$—C(O)—R |
| —O—CR═$CH_2$ | —CH═$CH_2$ |
| >C═O | —C(O)—NH—$NH_2$ |

1) * ——: Bonding site of the functional group to the molecule

Examples of suitable constituents for the thermally or thermally and photochemically (with actinic radiation) curable separate crosslinkers to be used in accordance with the invention (variant b), which comprise the above-described complementary reactive functional groups, are described in detail, for example, in German patent application DE 199 30 067 A1, page 3 lines 23 to 56, in conjunction with page 4 line 23, to page 7 line 19, page 7 line 20, page 9 line 20, page 9 lines 21 to 29, page 9 line 49, to page 11 line 37, page 11 lines 38 to 68, page 12 lines 30 to 55, and page 16 line 50, to page 17 line 13, German patent application DE 199 14 896 A1, column 11 line 6, to column 13 line 55, German patent application DE 199 04 317 A1, page 3 line 64, to page 4 line 2, in conjunction with page 4 line 7 to page 9 line 43, and page 15 lines 33 to 49, in conjunction with page 16 lines 30 to 45, or German patent application DE 198 18 735 A1, column two, pages 21 to 46, column 3 to column 6, line 33, and column 6 line 55 to column 7 line 35.

Examples of suitable constituents for separate crosslinkers curable with actinic radiation are described in detail in German patent application DE 197 36 083 A1, page 7 line 3, to page 8 line 38.

In a first embodiment, the intermolecular crosslinking is effected in such a way that the reactive groups of the essentially water-insoluble polymer react directly with one another under the action of heat (thermal crosslinking) and/or actinic radiation (photochemical crosslinking), and form covalent bonds between the individual polymer molecules (polymer chains) (variant a).

In a second embodiment, the interparticulate crosslinking is effected using at least one additional crosslinker, in which case covalent bonds are formed between one or more crosslinkers and the individual polymer molecules (polymer chains) under the action of heat (thermal crosslinking) and/or actinic radiation (photochemical crosslinking) (variant b).

The additional thermal and/or photoactive crosslinker used in the second embodiment of the interparticulate crosslinking is preferably present in the aqueous medium. More preferably, it is a water-soluble crosslinker.

Reactive groups which are suitable for thermal crosslinking and are present in the essentially water-insoluble polymer are known to those skilled in the art and are mentioned above. The reactive groups are, for example, selected from carbonyl groups, e.g. acetoneacetyl groups, carboxyl groups, carboxylic ester groups, carboxamide groups, amino groups, e.g. hydroxylamino groups such as —NH—$CH_2$—OH— groups, isocyanate groups, double bonds, epoxy groups, hydroxyl groups, halides, ethylene oxide groups, methylol groups, alkoxyalkyl groups, thiols, sulfonates, sulfates, silyl groups and ether groups.

Examples of groups suitable for photochemical crosslinking are (meth)acrylate, ethacrylate, crotonate, cinnamate, vinyl ether, vinyl ester, dicyclopentadienyl, norbornenyl, isoprenyl, isopropenyl, allyl or butenyl groups; dicyclopentadienyl ether, norbornenyl ether, isoprenyl ether, isopropenyl ether, allyl ether or butenyl ether groups, or dicyclopentadienyl ester, norbornenyl ester, isoprenyl ester, isopropenyl ester, allyl ester or butenyl ester groups, but especially acrylate groups.

These reactive groups are generally introduced during the preparation of the essentially water-insoluble polymer by copolymerization with suitable comonomers. Suitable comonomers are known to those skilled in the art and have, for example, the aforementioned reactive groups.

Suitable additional crosslinkers are known to those skilled in the art and depend upon the reactive groups in the polymer. Examples of suitable additional crosslinkers have already been mentioned above. Preferred additional crosslinkers are water-soluble compounds having two or more functional groups which are reactive with the reactive groups of the essentially water-insoluble polymer. Examples of a suitable crosslinker are hydrazides such as adipic hydrazide, aziridines, carbodiimides, epoxides, melamine-formaldehydes, isocyanates, amines, imines, oximes, alkyl hydroxides (alcohols), oxazolines, aminosilanes, thiols, hydroxylalkylamines, each of which has two or more functional groups.

Suitable crosslinkers are, for example, condensation products of urea, glyoxal and formaldehyde which may have been etherified with preferably linear $C_1$-$C_4$-alkanol, especially

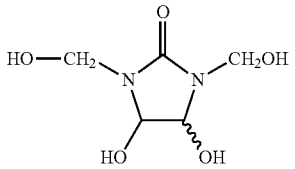

which has been di- to tetra-etherified with methanol or ethanol.

Further suitable crosslinkers are isocyanurates and especially hydrophilized isocyanurates, and also mixed hydrophilized diisocyanates/isocyanurates, for example, the isocyanurate of hexamethylene diisocyanate (HDI) which has been reacted with $C_1$-$C_4$-alkyl polyethylene glycol. Examples of such suitable crosslinkers are known, for example, from EP-A 0 486 881.

Among the above-described suitable separate crosslinkers, suitable crosslinkers are especially those which are crosslinkable thermally via keto groups or hydrazide groups. They are therefore used with particular preference in one embodiment.

The crosslinkers are preferably low molecular weight compounds having at least two hydrazide groups, or oligomers or polymers which comprise terminal or lateral or terminal and lateral hydrazide groups. Suitable oligomers and polymers stem from the polymer classes described below. Preference is given to using low molecular weight compounds having two hydrazide groups in the molecule.

Examples of suitable low molecular weight compounds having two hydrazide groups are the dihydrazides of organic dicarboxylic acids, such as $C_1$-$C_{20}$-dicarboxylic acids, which may be saturated or unsaturated, for example phthalic acid, terephthalic acid, naphthalenedicarboxylic acid, 1,2-, 1,3- or 1,4-cyclohexanedicarboxylic acid, sebacic acid or adipic acid. Particular preference is given to using adipic dihydrazide.

Particularly suitable comonomers which are suitable for preparing essentially water-insoluble polymers which can be thermally crosslinked are polyfunctional derivates of ethylenically unsaturated carboxylic acids, such as esters or amides thereof, for example compounds of the general formula I

I

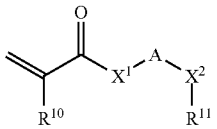

in which the variables are each defined as follows:

$X^1$, $X^2$ are the same or different and are each selected from oxygen, NH and N—$R^{11}$, A is a spacer, for example branched or unbranched $C_2$-$C_{20}$-alkylene or phenylene. Examples of $C_2$-$C_{20}$-alkylene are —$(CH_2)_2$—, —$CH_2$—$CH(CH_3)$—, —$(CH_2)_3$—, —$CH_2$—$CH(C_2H_5)$—, —$(CH_2)_4$—, —$(CH_2)_5$—, —$(CH_2)_6$—, —$(CH_2)_7$—, —$(CH_2)_8$—, —$(CH_2)_9$—, —$(CH_2)_{10}$—; preferably $C_2$-$C_4$-alkylene; especially —$(CH_2)_2$—, —$CH_2$—$CH(CH_3)$—, —$(CH_2)_3$—, —$(CH_2)_4$ — and —$CH_2$—$CH(C_2H_5)$—.

$R^{10}$, $R^{11}$ are the same or different and are selected from $C_1$-$C_{10}$-alkyl, for example methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl, more preferably unbranched $C_1$-$C_4$-alkyl such as methyl, ethyl, n-propyl and n-butyl.

Particularly suitable comonomers having epoxy groups are, for example, glycidyl esters of maleic acid, fumaric acid, E- and Z-crotonic acid, and especially of acrylic acid and of methacrylic acid.

Particularly suitable comonomers having NH—$CH_2OH$ groups are, for example, reaction products of formaldehyde with monoethylenically unsaturated carboxamides, especially N-methylolacrylamide and N-methylolmethacrylamide.

Particularly suitable comonomers having acetoacetyl groups are, for example, (meth)acrylates of alcohols of the general formula II

II

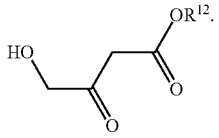

where $R^{12}$ is selected from unbranched and branched $C_1$-$C_{10}$-alkyl, such as methyl, ethyl, n-propyl, isopropyl, n-butyl, isobutyl, sec-butyl, tert-butyl, n-pentyl, isopentyl, sec-pentyl, neopentyl, 1,2-dimethylpropyl, isoamyl, n-hexyl, isohexyl, sec-hexyl, n-heptyl, n-octyl, 2-ethylhexyl, n-nonyl, n-decyl, more preferably unbranched $C_1$-$C_4$-alkyl such as methyl, ethyl, n-propyl and n-butyl.

Examples of comonomers suitable with preference are (meth)acryloyl compounds such as (meth)acrylamides, e.g. diacetoneacrylamide, (meth)acrylates, hydroxyethyl methacrylate, hydroxypropyl methacrylate, glycidyl methacrylate, diethylaminoethyl methacrylate, methacrylic acid, acrylic acid, maleic anhydride. Suitable comonomers comprise, as well as at least one polymerizable double bond, further reactive groups, as mentioned above.

In a particularly preferred embodiment, the essentially water-insoluble polymer has terminal or lateral or terminal and lateral carbonyl groups. Suitable polymers stem from the polymer classes, as described above, for the essentially water-insoluble polymers, (meth)acrylate copolymers being particularly advantageous.

In a very particularly preferred embodiment, the essentially water-insoluble polymer has carbonyl groups which are introduced into the copolymer by copolymerization of diacetoneacrylamide with the monomers used to prepare the essentially water-insoluble polymer, and the crosslinker used is adipic hydrazide.

In a further embodiment, an essentially water-insoluble polymer which has isocyanate groups or photoactive double bonds as reactive groups is used. This polymer is crosslinked preferably in the presence of a water-soluble photoactive crosslinker or photoinitiator which has groups reactive toward isocyanate groups or is suitable for crosslinking double bonds. Suitable photoactive crosslinkers are specified above. Suitable photoinitiators are known to those skilled in the art and are, for example, selected from benzophenones, phenylglyoxalic acids, acetophenones and hydroxyacetophenones, provided that they are soluble in the aqueous medium.

The amount of reactive groups in the essentially water-insoluble polymer and the amount of any additional crosslinker used depends upon factors including the desired degree of crosslinking.

In general, the amount of reactive groups in the essentially water-insoluble polymer is from 0.1 to 15% by weight, preferably from 0.2 to 10% by weight, based on the amount of monomers used. The amount of crosslinker in the aqueous medium is generally from 0.1 to 15% by weight, preferably from 0.2 to 10% by weight, based on the total amount of the monomers used.

The aforementioned crosslinking process has the advantage that, without additional further process steps, it is possible by means of the process according to the invention to obtain polymer fibers which are notable for high thermal stability and good elasticity at high temperatures.

The resulting polymer may be fully crosslinked, i.e. all (100%) of the groups of the polymer suitable for crosslinking are crosslinked, or partly crosslinked, i.e. only some 50 to 100%, preferably 60 to 98%, of the groups of the polymer suitable for crosslinking are crosslinked.

According to the present application, at least one essentially water-insoluble polymer is understood to mean either individual homo- and copolymers or mixtures of different homo- and copolymers. In addition, the expression "at least one essentially water-insoluble polymer" is also understood to mean polymer mixtures which, as well as the at least one homo- or copolymer, comprise, for example, a plasticizer. Suitable plasticizers generally depend on the homo- or copolymer used. Typical plasticizers are, for example, phthalic esters or polyvinyl alcohols. Suitable plasticizers are additionally, for example, hexahydrophthalic esters. In principle, it is known to those skilled in the art which plasticizers are suitable for which polymers or polymer mixtures.

The process according to the invention is carried out at a temperature of generally from 5 to 90° C. Preference is given to effecting the electrospinning process according to the invention at a temperature of from 10 to 70° C., more preferably at from 15 to 50° C.

In the context of the present invention, the process temperature is understood to mean the ambient temperature between the spinning source and counterelectrode during the electrospinning process. The spinning source may, for example, be a cannula or roller.

In principle, the colloidal polymer dispersions used in accordance with the invention may be prepared by all processes known to those skilled in the art for this purpose. Preference is given to preparing the colloidal dispersions by emulsion polymerization of suitable monomers to obtain the corresponding latices. In general, the latex obtained by emulsion polymerization is used in the process according to the invention directly without further workup. The colloidal polymer dispersions used may, for example, also be so-called secondary dispersions. These are prepared from polymers which have already been prepared by dispersion in an aqueous medium. In this way, it is possible, for example, to prepare dispersions of polyethylene or polyesters.

The aqueous medium in which the essentially water-insoluble polymer is present is generally water. The aqueous medium may, as well as water, comprise further additives. for example additives which are used in the emulsion polymerization of suitable monomers to produce a latex. Suitable additives are known to those skilled in the art.

In principle, in the process according to the invention, it is possible to use all essentially water-insoluble polymers known to those skilled in the art, provided they are suitable for crosslinking by interparticulate crosslinking. Suitable additional comonomers which comprise the polymers and copolymers mentioned below, in order that they can be crosslinked by interparticulate crosslinking, are specified above.

The at least one essentially water-insoluble polymer is preferably selected from the group consisting of poly(p-xylylene); homo- and copolymers of vinyl halides; polyesters; polyethers; polyolefins; homo- and copolymers of conjugated dienes such as butadiene or isoprene; polycarbonates; polyurethanes; natural polymers; polycarboxylic acids; polysulfonic acids; sulfated polysaccharides; polylactides; polyglycosides; polyamides; homo- and copolymers of aromatic vinyl compounds; polyacrylonitriles; polymethacrylonitriles; polyacrylamides; polyimides; polyphenylenes; polysilanes; polysiloxanes; polybenzimidazoles; polybenzothiazoles; polyoxazoles; polysulfides; polyesteramides; polyarylenevinylenes; polyetherketones; polyurethanes; polysulfones; inorganic-organic hybrid polymers; silicones; fully aromatic copolyesters; homo- and copolymers of alkyl acrylates; homo- and copolymers of alkyl methacrylates; polyhydroxyethyl methacrylates; polyvinyl acetates; polyisoprene; synthetic rubbers; polybutadiene; polytetrafluoroethylene; modified and unmodified celluloses; homo- and copolymers of α-olefins; homo- and copolymers of vinyl alcohols (provided that they are essentially water-insoluble); homo- and copolymers based on melamine-containing compounds; copolymers formed from two or more monomer units which form the aforementioned polymers and combinations thereof; and copolymers of acrylates, methacrylates, vinyl alcohols and/or vinylaromatics with acrylic acid, maleic acid, fumaric acid, methacrylic acid and/or itaconic acid (provided that they are essentially water-insoluble), said at least one essentially water-insoluble polymer having reactive groups which are suitable for crosslinking and enable interparticulate crosslinking, if appropriate using an additional crosslinker or photoinitiator.

Particularly preferred suitable essentially water-insoluble polymers are, for example, selected from the group consisting of homo- and copolymers of aromatic vinyl compounds, homo- and copolymers of alkyl acrylates, homo- and copolymers of alkyl methacrylates, homo- and copolymers of α-olefins, homo- and copolymers of vinyl halides, homo- and copolymers of vinyl acetates, homo- and copolymers of acrylonitriles, homo- and copolymers of urethanes, homo- and copolymers of vinyl amides and copolymers formed from two or more of the monomer units which form the aforementioned polymers, said at least one essentially water-insoluble polymer having reactive groups which are suitable for crosslinking and enable interparticulate crosslinking, if appropriate using an additional crosslinker or photoinitiator.

Suitable homo- and copolymers of aromatic vinyl compounds are homo- and copolymers based on poly(alkyl)styrenes, e.g. polystyrene, poly-α-methylstyrene, styrene/alkyl acrylate copolymers, especially styrene/n-butyl acrylate copolymers, styrene/alkyl methacrylate copolymers, acrylonitrile/styrene/acrylic ester copolymers (ASA), styrene/acrylonitrile copolymers (SAN), acrylonitrile/butadiene/styrene copolymers (ABS), styrene/butadiene copolymers (SB), where the at least one essentially water-insoluble polymer has reactive groups which are suitable for crosslinking and enable interparticulate crosslinking, if appropriate using an additional crosslinker or photoinitiator.

The at least one essentially water-insoluble polymer is preferably selected from the group consisting of polystyrene, poly-α-methylstyrene, styrene/alkyl acrylate copolymers, especially styrene/n-butyl acrylate copolymers, styrene/alkyl methacrylate copolymers, α-methylstyrene/alkyl acrylate copolymers, α-methylstyrene/alkyl methacrylate copolymers, poly(alkyl)methacrylates, polyethylene, ethylene/vinyl acetate copolymers, ethylene/acrylate copolymers, polyvinyl chloride, polyalkylnitrile and polyvinyl acetate, polyurethanes, styrene-butadiene copolymers and styrene-acrylonitrile-butadiene copolymers.

More preferably, the at least one essentially water-insoluble polymer is selected from styrene/alkyl acrylate copolymers, especially styrene/n-butyl acrylate copolymers, and styrene/alkyl methacrylate copolymers.

Suitable alkyl acrylates used in the styrene/alkyl acrylate copolymers are, for example, n-butyl acrylate, isobutyl acrylate, tert-butyl acrylate, ethyl acrylate, 2-ethylhexyl acrylate, n-hexyl acrylate, 2-hydroxyethyl acrylate, hydroxypropyl acrylate, lauryl acrylate, methyl acrylate and n-propyl acrylate, preference being given to n-butyl acrylate, ethyl acrylate, methyl acrylate and 2-ethylhexyl acrylate.

Suitable alkyl methacrylates used in the styrene/alkyl methacrylate copolymers are, for example, n-butyl methacrylate, isobutyl methacrylate, tert-butyl methacrylate, ethylhexyl methacrylate, glycidyl methacrylate, hydroxy methacrylate, hydroxypropyl methacrylate, n-propyl acrylate, i-propyl acrylate and n-pentyl methacrylate, preferably n-butyl methacrylate, ethylhexyl methacrylate and methyl methacrylate.

In addition to the aforementioned homo- and copolymers, suitable copolymers are additionally those which additionally—i.e. in addition to the monomer units from which the aforementioned homo- and copolymers are formed—comprise functionalized comonomers. Suitable functionalized comonomers are, for example, comonomers which—after incorporation into the copolymer—are suitable for inter- or intramolecular crosslinking. Suitable comonomers are specified below. The glass transition temperature of such copolymers comprising functionalized comonomers can be determined by the aforementioned methods known to those skilled in the art, especially DSC, or can be calculated easily with the aid of the Fox equation.

The proportion of the different monomer units in the aforementioned copolymers is variable (and depends upon the desired glass transition temperature). In the case of the styrene/n-butyl acrylate copolymers, the proportion of styrene in the copolymers is generally from 30 to 100% by weight, preferably from 40 to 95% by weight, and the proportion of n-butyl acrylate is from 0 to 70% by weight, preferably from 5 to 60% by weight, where the sum total of styrene and alkyl acrylate or alkyl methacrylate is 100% by weight.

The reactive groups suitable for crosslinking are generally obtained by copolymerizing a suitable monomer during the preparation of the essentially water-insoluble polymers, suitable monomers having been specified above.

The aforementioned essentially water-insoluble polymers are commercially available or can be prepared by processes known to those skilled in the art. In a preferred embodiment of the present invention, essentially water-insoluble polymers prepared by emulsion polymerization are used. Suitable monomers are known to those skilled in the art. The polymer latex obtained in the emulsion polymerization can be used directly in the electrospinning process according to the invention as a colloidal dispersion.

Particularly good results are obtained in the process according to the invention with colloidal polymer suspensions wherein the average weight-average particle diameter of the at least one essentially water-insoluble polymer is generally from 1 nm to 2.5 μm, preferably from 10 nm to 1.2 μm, more preferably from 15 nm to 1 μm. The average weight-average particle diameter of latex particles produced by emulsion polymerization, which are used in a preferred embodiment in the process according to the invention, is generally from 30 nm to 2.5 μm, preferably from 50 nm to 1.2 μm (determined according to W. Scholtan and H. Lange in Kolloid-Z. and Polymere 250 (1972), p. 782-796, by means of an ultracentrifuge). Very particular preference is given to using colloidal polymer suspensions, especially latices, in which the polymer particles have a weight-average particle diameter of from 20 nm to 500 nm, very especially preferably from 30 nm to 250 nm.

The colloidal suspension used with preference in accordance with the invention may comprise particles with monomodal particle size distribution of the polymer particles or with bi- or polymodal particle size distribution. The terms mono-, bi- and polymodal particle size distribution are known to those skilled in the art.

When the latex to be used in accordance with the invention is based on two or more monomers, the latex particles may be arranged in any manner known to those skilled in the art. Merely by way of example, mention is made of particles with gradient structure, core-shell structure, salami structure, multicore structure, multilayer structure and raspberry morphology.

The term "latex" should also be understood to mean the mixture of two or more latices. The mixture can be prepared by all processes known for this purpose, for example by mixing of two latices at any time before the spinning.

In a further preferred embodiment of the present invention, the colloidal dispersion additionally comprises, as well as the at least one water-insoluble polymer, at least one water-soluble polymer, water-soluble polymer being understood in the context of the present invention to mean a polymer having a solubility in water of at least 0.1% by weight.

Without being bound to a theory, the at least one water-soluble polymer which is preferably present additionally in the colloidal dispersions may serve as so-called template polymer. With the aid of the template polymer, the fiber formation from the colloidal polymer dispersion (electrospinning) is favored further over spraying (electrospraying). The template polymer serves as a kind of "thickener" for the essentially water-insoluble polymers of the colloidal dispersion.

After the production of the polymer fibers by the process according to the invention, the water-soluble polymer, in a preferred embodiment of the process according to the invention, is removed, for example, by washing/extraction with water.

After the water-soluble polymers have been removed, water-insoluble polymer fibers, especially nano- and microfibers, are obtained without disintegration of the polymer fibers.

The water-soluble polymer may be a homopolymer, copolymer, block polymer, graft copolymer, star polymer, highly branched polymer, dendrimer or a mixture of two or more of the aforementioned polymer types. According to the findings of the present invention, the addition of at least one water-soluble polymer does not only accelerate/promote the fiber formation. Instead, the quality of the resulting fibers is also significantly improved.

In principle, all water-soluble polymers known to those skilled in the art may be added to the colloidal dispersion of at least one essentially water-soluble polymer in an aqueous medium, particularly good results being achieved especially with water-soluble polymers selected from the group consisting of polyvinyl alcohol, polyvinylformamide, polyvinylamine, polycarboxylic acid (polyacrylic acid, polymethacrylic acid), polyacrylamide, polyitaconic acid, poly(2-hydroxyethyl acrylate), poly(N-isopropylacrylamide), polysulfonic acid (poly(2-acrylamido-2-methyl-1-propanesulfonic acid) or PAMPS), polymethacrylamide, polyalkylene oxides, for example polyethylene oxides; poly-N-vinylpyrrolidone; hydroxymethylcelluloses; hydroxyethylcelluloses; hydroxypropylcelluloses; carboxymethylcelluloses; maleic acids; alginates; collagens; gelatin, poly(ethyleneimine), polystyrenesulfonic acid; combinations formed from two or more of the monomer units which form the aforementioned polymers, copolymers formed from two or more of the monomer units which form the aforementioned polymers, graft copolymers formed from two or more of the monomer units which form the aforementioned polymers, star polymers formed from two or more of the monomer units which form the aforementioned polymers, highly branched polymers formed from two or more of the monomer units which form the aforementioned polymers, and dendrimers formed from two or more of the monomer units which form the aforementioned polymers.

In a preferred embodiment of the present invention, the water-soluble polymer is selected from polyvinyl alcohol, polyethylene oxides, polyvinylformamide, polyvinylamine and poly-N-vinylpyrrolidone.

The aforementioned water-soluble polymers are commercially available or can be prepared by processes known to those skilled in the art.

Irrespective of the embodiment, the solids content of the colloidal dispersion to be used in accordance with the invention—based on the total weight of the dispersion—is preferably from 5 to 60% by weight, more preferably from 10 to 50% by weight and most preferably from 10 to 40% by weight.

In the further embodiment of the present invention, the colloidal dispersion comprising at least one essentially water-insoluble polymer and if appropriate at least one water-soluble polymer in an aqueous medium to be used in the process according to the invention comprises, based on the total weight of the dispersion, from 0 to 25% by weight, more preferably from 0.5 to 20% by weight and most preferably from 1 to 15% by weight of at least one water-soluble polymer.

The colloidal dispersions used in accordance with the invention thus comprise, in a preferred embodiment, based in each case on the total amount of the colloidal dispersion, i) from 5 to 60% by weight, preferably from 10 to 50% by weight, more preferably from 10 to 40% by weight, of at least one essentially water-insoluble polymer, ii) from 0 to 25% by weight, preferably from 0.5 to 20% by weight, more preferably from 1 to 15% by weight, of at least one water-soluble polymer, and iii) from 15 to 95% by weight, preferably from 30 to 89.5% by weight, more preferably from 45 to 89% by weight, of water, where the sum total of the components specified under i), ii) and iii) is 100% by weight.

The weight ratio of essentially water-insoluble polymer to the water-soluble polymer which is preferably present in the colloidal dispersion is dependent upon the polymers used. For example, the essentially water-insoluble polymer and the water-soluble polymer used with preference may be used in a weight ratio of from 300:1 to 1:5, preferably from 100:1 to 1:2, more preferably from 40:1 to 1:1.5.

The colloidal dispersion to be used in accordance with the invention can be electrospun by all methods known to those skilled in the art, for example by extrusion of the dispersion, preferably of the latex, under low pressure through a cannula connected to one pole of a voltage source toward a counterelectrode arranged at a distance from the cannula exit. The distance between the cannula and the counterelectrode functioning as the collector and the voltage between the electrodes are preferably adjusted such that an electrical field of preferably from 0.1 to 9 kV/cm, more preferably from 0.3 to 6 kV/cm and most preferably from 0.5 to 2 kV/cm is formed between the electrodes.

Good results are obtained especially when the internal diameter of the cannula is from 50 to 500 μm.

The present invention further provides fibers, especially nano-fibers and mesofibers, which are obtainable by the process according to the invention. The inventive fibers are notable in that, owing to the inventive interparticulate crosslinking, they have optimized thermal properties, especially with regard to elasticity.

The diameter of the inventive fibers is preferably from 10 nm to 50 μm, more preferably from 50 nm to 2 μm and most preferably from 100 nm to 1 μm. The length of the fibers depends on the end use and is generally from 50 μm up to several kilometers.

The inventive polymer fibers are suitable for further processing, for example by weaving of the inventive polymer fibers to textile fabrics.

The present invention therefore further provides textile fabrics comprising polymer fibers according to the present invention. Preferred embodiments of the inventive polymer fibers are specified above. The textile fabrics may be formed exclusively from the inventive polymer fibers or, as well as the inventive polymer fibers, comprise conventional fibers known to those skilled in the art. It is, for example, possible that the inventive textile fabric is formed from conventional fibers and has a layer (sheet) which comprises the inventive polymer fibers. It is additionally possible, for example, that the textile fabric is formed from a mixture of conventional fibers and inventive polymer fibers.

These textile fabrics or else the inventive polymer fibers themselves may be used for numerous applications. Preferred applications are selected from the group consisting of use in the following applications: filters or filter parts, nonwovens, fleeces, especially for gas, air and/or liquid filtration, industrial or domestic textiles or constituents or coatings of such textiles, such as wiping cloths, cosmetic cloths, clothing, medical textiles, etc., coatings or constituents of packaging, for example coatings of paper, for use in wound healing, or as a wound covering, for transport or for release of active ingredients and effect substances, for example in medicine, agriculture or cosmetics, cell culture carriers, catalyst supports, sensors or components thereof, acoustic dampers, precursors for producing other fibers (organic, inorganic), and also continuous layers, for example films, as additives for polymers, coatings for improving tactile properties, optical properties, for example reflection properties, and appearance, membrane production, and adsorbers and absorbers of solid, liquid and gaseous media.

In most of these applications, the inventive polymer fibers are used in the form of textile fabrics. The production of textile fabrics from the inventive polymer fibers is known to those skilled in the art and can be effected by all customary processes. However, it is also possible to use the inventive fibers themselves, for example as additives (fillers) for polymers or as precursors for producing other fibers and continuous layers.

Further aims, features, advantages and possible uses of the invention are evident from the description of working examples which follows and the drawings. All features described and/or illustrated in image form, alone or in any combination, form the subject matter of the invention, irrespective of their combination in the claims or the claims to which they refer back.

Figure 2:
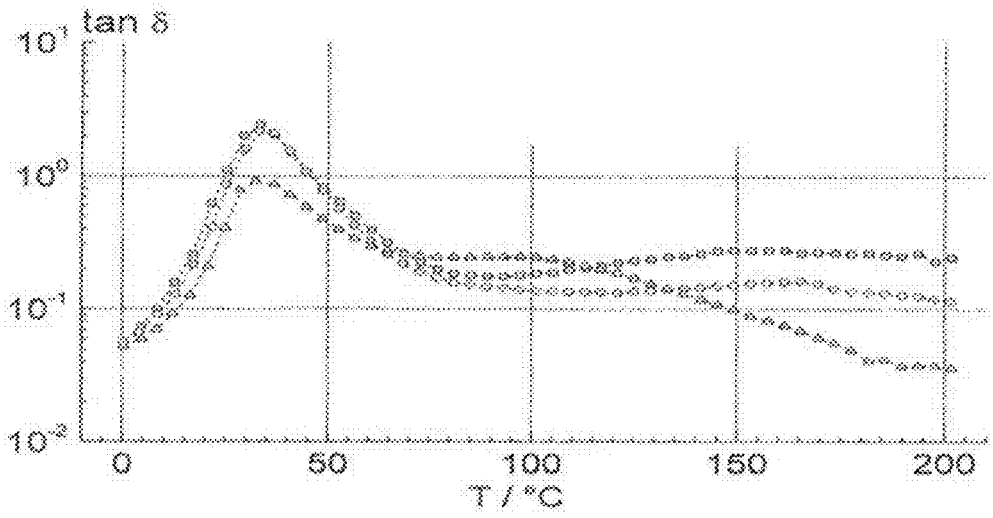

The figures show:

FIG. 1 a schematic illustration of an apparatus suitable for performing the electrospinning process according to the invention, FIG. 2 elastic properties of crosslinked polymer films produced from dispersions according to Example 1 (inventive, intermolecularly crosslinked), from dispersions according to Example C2 (comparative, intramolecularly crosslinked), and of uncrosslinked polymer films produced from dispersions according to Example C3 (comparative), as a function of temperature.

Figure 3A:
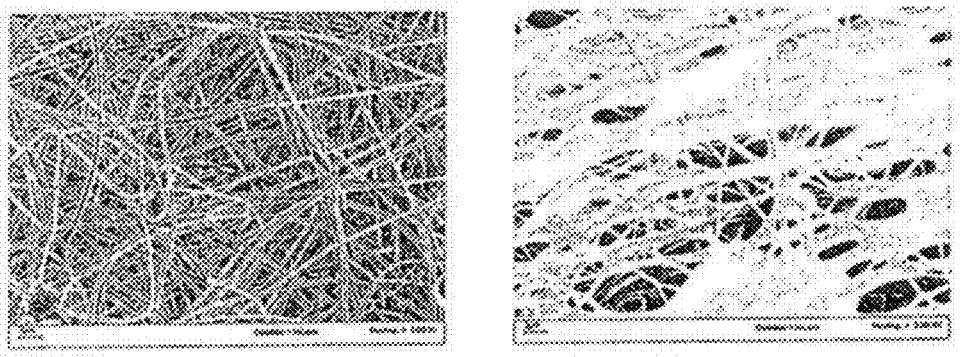
Figure 3B:
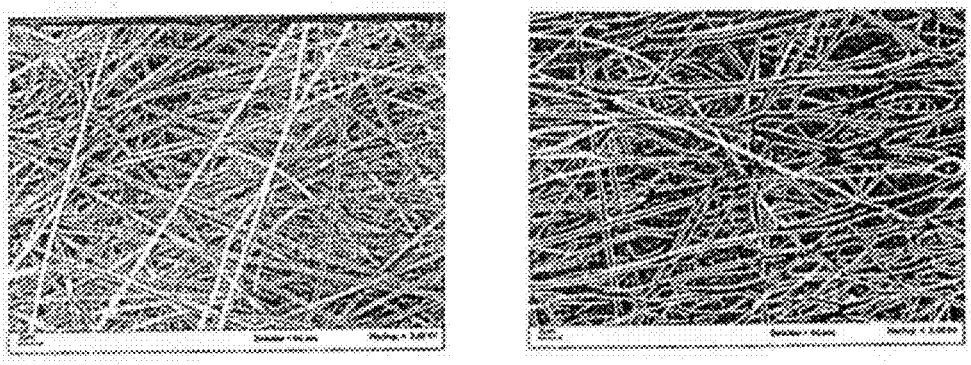
Figure 3C:
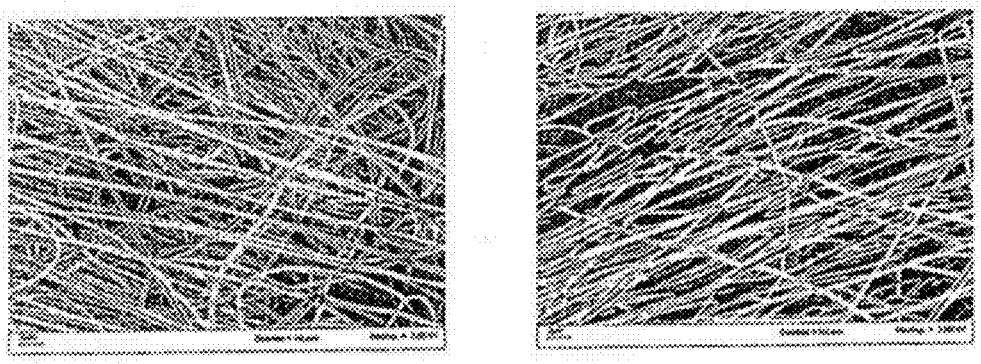

FIG. 3 scanning electron micrograph of the fibers obtained according to Example 1 (FIG. 3*c*), C2 (FIG. 3*b*) and C3 (FIG. 3*c*), at 20° C. and heated to 200° C.

The apparatus for electrospinning which is suitable for performing the process according to the invention and is shown in FIG. 1 comprises a syringe 3 which is provided at its tip with a capillary die 2 which is connected to one pole of a voltage source 1 and is for accommodating the inventive colloidal dispersion 4. Opposite the exit of the capillary die 2, at a distance of about 20 cm, is arranged a square counterelectrode 5 connected to the other pole of the voltage source 1, which functions as the collector for the fibers formed.

During the operation of the apparatus, a voltage of 30 kV is set at the electrodes 2, 5, and the colloidal dispersion 4 is discharged under a low pressure through the capillary die 2 of the syringe 3. Owing to the electrostatic charge of the essentially water-insoluble polymers in the colloidal dispersion which results from the strong electrical field of from 0.1 to 10 kV/cm, a material flow directed toward the counterelectrode 5 forms, and solidifies on the way to the counterelectrode 5 with fiber formation 6, as a consequence of which fibers 7 with diameters in the micrometer and nanometer range are deposited on the counterelectrode 5.

With the aforementioned apparatus, in accordance with the invention, a colloidal dispersion of at least one essentially water-insoluble polymer and of at least one nonionic surfactant in an aqueous medium is electrospun.

The solids content within the dispersion is determined gravimetrically by means of a Mettler Toledo HR73 halogen moisture analyzer, by heating approx. 1 ml of the sample to 200° C. within 2 minutes and drying the sample to constant weight and then weighing it.

The mean particle size is the weight average $d_{50}$, determined by means of an analytical ultracentrifuge (according to W. Scholtan and H. Lange in Kolloid-Z. and Polymere 250 (1972), p. 782-796).

The size, i.e. the diameter and the length of the fibers, is determined by evaluating electron micrographs.

1. Preparation of the Colloidal Dispersions (C3; Comparative Example 3, Uncrosslinked)

The polymer latex used in Example C3 which follows comprises a styrene/n-butyl acrylate copolymer in an amount of 37.5% by weight, based on the total weight of the polymer latex. The mean particle size (weight average, $d_{50}$) is 137 nm. The copolymers are formed from 50% by weight of styrene and 50% by weight of n-butyl acrylate.

The polymer latices comprising the copolymer mentioned are prepared by customary processes known to those skilled in the art. Typically, a polymer latex having a content of styrene/n-butyl acrylate copolymer of >30% by weight is obtained, which is subsequently diluted to the desired concentration with water.

The water-soluble polymer used is poly(vinyl alcohol) (PVA) having a weight-average molecular weight ($M_W$) of 145 000 g/mol, which has been hydrolyzed to an extent of 99% (MOWIOL® 28-99 from Kuraray Specialities Europe KSE).

The colloidal dispersions used for electrospinning are prepared by mixing a latex comprising a styrene/n-butyl acrylate copolymer with water. The solids content of the dispersion to be spun is 19.4% by weight. The aforementioned polyvinyl alcohol is added to the polymer latex in aqueous solution (10% by weight), such that the colloidal dispersion to be spun comprises approx. 4.8% by weight of PVA and the weight ratio of styrene/n-butyl acrylate copolymer to polyvinyl alcohol (PVA) in the mixture is approx. 80:20.

2. Preparation of the Crosslinked (Example C2, Comparative Example 2) and Crosslinkable (Example 1, Inventive) Polymer Dispersions Example C2

Intraparticulate Crosslinking, Comparative

The polymer latex used in Example C2 comprises a styrene/n-butyl acrylate copolymer, which is additionally formed from 0.5% by weight of a crosslinking monomer, allyl methacrylate (AMA), (styrene/n-butyl acrylate/AMA copolymer) in an amount of 38.6% by weight, based on the total weight of the polymer latex. The mean particle size (weight average, $d_{50}$) is 109 nm. The copolymers are formed from 49.0% by weight of styrene and 47.7% by weight of n-butyl acrylate and 0.5% by weight of AMA, the remainder in the polymer latex (calculated to 100% by weight) being acrylic acid and acrylamide. The copolymer has a $T_g$ of 28.3° C.

The polymer latices comprising the copolymer mentioned are prepared by customary processes known to those skilled in the art. Typically, a polymer latex having a content of styrene/n-butyl acrylate copolymer of >30% by weight is obtained, which is subsequently diluted to the desired concentration with water.

The water-soluble polymer used is poly(vinyl alcohol) (PVA) having a weight-average molecular weight ($M_W$) of 145 000 g/mol, which has been hydrolyzed to an extent of 99% (MOWIOL® 28-99 from Kuraray Specialities Europe KSE).

The colloidal dispersions used for electrospinning are prepared by mixing the latex comprising the styrene/n-butyl acrylate/AMA copolymer with water. The solids content of the dispersion to be spun is 19.4% by weight. The aforementioned polyvinyl alcohol is added to the polymer latex in aqueous solution (10% by weight), such that the colloidal dispersion to be spun comprises approx. 4.8% by weight of PVA and the weight ratio of styrene/n-butyl acrylate/AMA copolymer to polyvinyl alcohol (PVA) in the mixture is approx. 80:20.

Example 1

Interparticulate Crosslinking, Inventive

The polymer latex used in Example 1 comprises a styrene/n-butyl acrylate copolymer, which is additionally formed from 4% by weight of a crosslinking monomer (which crosslinks together with an additional crosslinker), diacetoneacrylamide (DAAM), (styrene/n-butyl acrylate/DAAM copolymer) in an amount of 38.8% by weight, based on the total weight of the polymer latex. The mean particle size (weight average, $d_{50}$) is 111 nm. The copolymers are formed from 47.3% by weight of styrene and 45.9% by weight of n-butyl acrylate and 4.0% by weight of DAAM, the remainder in the polymer latex (calculated to 100% by weight) being acrylic acid and acrylamide. The copolymer has a $T_g$ of 30.7° C.

The polymer latices comprising the copolymer mentioned are prepared by customary processes known to those skilled in the art. Typically, a polymer latex having a content of styrene/n-butyl acrylate copolymer of >30% by weight is obtained, which is subsequently diluted to the desired concentration with water.

The water-soluble polymer used is poly(vinyl alcohol) (PVA) having a weight-average molecular weight ($M_W$) of 145 000 g/mol, which has been hydrolyzed to an extent of 99% (MOWIOL® 28-99 from Kuraray Specialities Europe KSE).

The colloidal dispersions used for electrospinning are prepared by mixing the latex comprising the styrene/n-butyl acrylate/DAAM copolymer with water. The solids content of the dispersion to be spun is 19.4% by weight. The aforementioned polyvinyl alcohol is added to the polymer latex in aqueous solution (10% by weight), such that the colloidal dispersion to be spun comprises approx. 4.8% by weight of PVA and the weight ratio of styrene/n-butyl acrylate/DAAM copolymer to polyvinyl alcohol (PVA) in the mixture is approx. 80:20. In addition, adipic dihydrazide is added as an additional crosslinker, the molar amount of adipic dihydrazide corresponding to half of the molar amount of DAAM in the styrene/n-butyl acrylate/DAAM copolymer.

3. Electrospinning of the Dispersions 1, C2 and C3 Prepared

The colloidal dispersions 1, C2 and C3 prepared according to number 1 and 2 are electrospun in the apparatus shown in FIG. 1.

The dispersion is conveyed at a temperature of 22-24° C. through a syringe 3 having a capillary die 2 with an internal diameter of 0.3 mm provided at its tip with a sample feed rate of 0.5 ml/h, the distance between the electrodes 2, 5 being 200 mm and a voltage of 30 kV being applied between the electrodes. To remove the water-soluble polymer, the resulting fibers are treated with water at room temperature for 17 hours.

FIG. 2 shows the loss of the elastic properties of the crosslinked polymer films (Example C2) or of the polymer films to be crosslinked (Example 1) (Example 2C: intraparticulate crosslinking (Comparative Example), Example 1: interparticulate crosslinking (inventive)) and the loss of the elastic properties of the uncrosslinked polymer films according to Example 3C (Comparative Example) as a function of temperature; measured with Rheometrics Solid Analyzer, heating rate 2° C./min, frequency 1 Hz; length of the film 34.5 mm, width 6.0 mm, thickness between 0.43 and 0.51 mm. For technical reasons, the elastic properties were measured on polymer films. The resulting information with regard to the polymer films allows the elastic properties of the inventive polymer fibers to be concluded.

In FIG. 2, the symbols mean:

squares: tan δ of the uncrosslinked polymer fibers (Example 2)

circles: tan δ of the intraparticulately crosslinked polymer fibers (Example 3a)

triangles: tan δ of the interparticulately crosslinked polymer fibers (Example 3b)

tan δ ratio of the loss modulus to the storage modulus.

FIG. 2 shows that the loss of the elastic properties of the polymer fibers, as the temperature is increased, is the greatest for the uncrosslinked fibers and the lowest for the interparticulately crosslinked fibers.

For illustration, FIG. 3 shows scanning electron micrographs which show the crosslinked polymer fibers according to Example 2C and 1 (FIGS. 3*b* and 3*c*) and the uncrosslinked polymer fibers according to C3 (FIG. 3*a*) at 20° C. and with brief exposure at 200° C.

It is noticeable that the intermolecularly crosslinked polymer fibers maintain their shape at best, while the uncrosslinked polymer fibers deliquesce at 200° C. (FIG. 3*a*).

When the inventive polymer fibers are employed at high temperatures, an improvement in the thermal stability can thus be achieved through intermolecular crosslinking.

REFERENCE NUMERAL LIST

1 Voltage source
2 Capillary die
3 Syringe
4 Colloidal dispersion
5 Counterelectrode
6 Fiber formation
7 Fiber mat

The invention claimed is:

1. A process for producing polymer fibers by electrospinning a colloidal dispersion of at least one essentially water-insoluble polymer having a solubility in water of less than 0.1% by weight in an aqueous medium, which comprises crosslinking the at least one essentially water-insoluble polymer by interparticulate crosslinking during the electrospinning, wherein the interparticulate crosslinking is effected through formation of covalent bonds by thermal means, and wherein the colloidal dispersion comprises, based on the total weight of the dispersion from 0.5 to 20% by weight of a water-soluble polymer; and wherein the at least one essentially water-insoluble polymer has reactive groups suitable for crosslinking which enable interparticulate crosslinking using an additional crosslinker; and wherein the additional crosslinker is present in the aqueous medium; and wherein the additional crosslinker is a water-soluble compound having two or more functional groups which are reactive with the reactive groups of the essentially water-insoluble polymer, wherein the crosslinkers are crosslinkable thermally via keto groups or hydrazide groups.

2. The process according to claim 1, wherein the reactive groups suitable for crosslinking in the essentially water-insoluble polymer are selected from carbonyl groups, carboxyl groups, carboxylic ester groups, carboxamide groups, amino groups, isocyanate groups, double bonds, epoxy groups, hydroxyl groups, halides, ethylene oxide groups, methylol groups, alkoxyalkyl groups, thiols, sulfonates, sulfates, silyl groups and ether groups.

3. The process according to claims 1, wherein the essentially water-insoluble polymer has carbonyl groups which are introduced into the copolymer by copolymerization of diacetoneacrylamide with the monomers used to prepare the essentially water-insoluble polymer, and the crosslinker used is adipic hydrazide.

4. The process according to claim 1, wherein the at least one essentially water-insoluble polymer is selected from the group consisting of poly(p-xylylene); homo- and copolymers of vinyl halides; polyesters; polyethers; polyolefins; homo- and copolymers of conjugated dienes; polycarbonates; polyurethanes; natural polymers; polycarboxylic acids; polysulfonic acids; sulfated polysaccharides; polylactides; polyglycosides; polyamides; homo- and copolymers of aromatic vinyl compounds; polyacrylonitriles; polymethacrylonitriles; polyacrylamides; polyimides; polyphenylenes; polysilanes; polysiloxanes; polybenzimidazoles; polybenzothiazoles; polyoxazoles; polysulfides; polyesteramides; polyarylenevinylenes; polyetherketones; polyurethanes; polysulfones; inorganic-organic hybrid polymers; silicones; fully aromatic copolyesters; homo- and copolymers of alkyl acrylates; homo- and copolymers of alkyl methacrylates; polyhydroxyethyl methacrylates; polyvinyl acetates; polyisoprene; synthetic rubbers; polybutadiene; polytetrafluoroethylene; modified and unmodified celluloses; homo- and copolymers of α-olefins; homo- and copolymers of vinyl alcohols, provided that they are essentially water-insoluble; homo- and copolymers based on melamine-containing compounds; copolymers formed from two or more monomer units which form the aforementioned polymers and combinations thereof; and copolymers of acrylates, methacrylates, vinyl alcohols and/or vinylaromatics with acrylic acid, maleic acid, fumaric acid, methacrylic acid and/or itaconic acid, provided that they are essentially water-insoluble, said at least one essentially water-insoluble polymer having reactive groups which are suitable for crosslinking and enable interparticulate crosslinking, using an additional crosslinker.

5. The process according to claim 4, wherein the at least one essentially water-insoluble polymer is selected from the group consisting of homo- and copolymers of aromatic vinyl compounds, homo- and copolymers of alkyl acrylates, homo- and copolymers of alkyl methacrylates, homo- and copolymers of α-olefins, homo- and copolymers of vinyl halides, homo- and copolymers of vinyl acetates, homo- and copolymers of acrylonitriles, homo- and copolymers of urethanes, homo- and copolymers of vinyl amides and copolymers formed from two or more of the monomer units which form the aforementioned polymers, said at least one essentially water-insoluble polymer having reactive groups suitable for crosslinking and enable interparticulate crosslinking, using an additional crosslinker.

6. The process according to claim 5, wherein the at least one essentially water-insoluble polymer is selected from styrene/alkyl acrylate copolymers and styrene/alkyl methacrylate copolymers, said at least one essentially water-insoluble polymer having reactive groups which are suitable for crosslinking and enable interparticulate crosslinking, using an additional crosslinker.

7. The process according to claim 1, wherein the average weight-average particle diameter of the at least one essentially water-insoluble polymer is between 1 nm and 2.5 μm.

8. The process according to claim 1, wherein the water-soluble polymer is selected from the group consisting of homopolymers, copolymers, graft copolymers, star polymers, highly branched polymers and dendrimers.

9. The process according to claim 8, wherein the water-soluble polymer is selected from the group consisting of polyvinyl alcohol, polyvinylformamide, polyvinylamine, polycarboxylic acid, polyacrylamide, polyitaconic acid, poly(2-hydroxyethyl acrylate), poly(N-isopropylacrylamide), polysulfonic acid, polymethacrylamide, polyalkylene oxides; poly-N-vinylpyrrolidone; hydroxymethylcelluloses; hydroxyethylcelluloses; hydroxypropylcelluloses; carboxymethylcelluloses; maleic acids; alginates; collagens; gelatin, poly(ethyleneimine), polystyrenesulfonic acid; combinations formed from two or more of the monomer units which form the aforementioned polymers, copolymers formed from two or more of the monomer units which form the aforementioned polymers, graft copolymers formed from two or more of the monomer units which form the aforementioned polymers, star polymers formed from two or more of the monomer units which form the aforementioned polymers, highly branched polymers formed from two or more of the monomer units which form the aforementioned polymers, and dendrimers formed from two or more of the monomer units which form the aforementioned polymers.

10. The process according to claim 8, wherein the solids content of the colloidal dispersion, based on the total weight of the dispersion, is from 5 to 60% by weight.

* * * * *